US005761909A

United States Patent [19]

Hughes et al.

[11] Patent Number: 5,761,909

[45] Date of Patent: Jun. 9, 1998

[54] BREATHING GAS TEMPERATURE MODIFICATION DEVICE

[75] Inventors: Robert J. Hughes; Kenneth Price, both of Lynn Haven, Fla.; Dennis McCrory, Ellicott City, Md.; Billy Courson; Joseph Rudolph, both of Panama City, Fla.

[73] Assignee: The United States of America as represented by the Secretary of the Navy, Washington, D.C.

[21] Appl. No.: 767,507

[22] Filed: Dec. 16, 1996

[51] Int. Cl.[6] ..... F25B 21/02

[52] U.S. Cl. ..... 62/3.7; 62/3.2; 165/DIG. 9

[58] Field of Search ..... 62/3.7, 259.3, 62/434, 3.2, 3.3; 165/47, 104.17, 104.18, DIG. 9

[56] References Cited

U.S. PATENT DOCUMENTS 5,115,859 5/1992 Roebelen, Jr. et al. ..... 62/3.7

5,193,347 3/1993 Apisdorf ..... 62/259.3

*Primary Examiner*—John M. Sollecito

*Attorney, Agent, or Firm*—Harvey A. Gilbert

[57] ABSTRACT

A device is provided for modifying the temperature of a breathing or other gas supplied through a conduit. A heat exchanger is mounted in-line with the conduit. A thermoelectric device has first and second thermally conductive plates separated by at least one thermoelectric couple. The first thermally conductive plate is in thermal contact with the heat exchanger. A phase change material is in thermal contact with the second thermally conductive plate. A voltage is applied to the thermoelectric couple(s) to maintain the first and second thermally conductive plates at different temperatures. The phase change material changes from a first phase to a second phase at a phase change temperature that is selected to be between the different temperatures of the first and second thermally conductive plates.

15 Claims, 2 Drawing Sheets

BREATHING GAS TEMPERATURE MODIFICATION DEVICE

ORIGIN OF THE INVENTION

The invention described herein was made in the performance of official duties by employees of the Department of the Navy and may be manufactured, used, licensed by or for the Government for any governmental purpose without payment of any royalties thereon.

1. Field of the Invention

The invention relates generally to breathing gas devices, and more particularly to a device that can be adapted to heat or cool breathing gas to compensate for ambient temperature extremes.

2. Background of the Invention

Breathing gas devices are used for a variety of hazardous situations, e.g., fire-fighting, hazardous material (hazmat) handling or disasters, chemical warfare, underwater diving, etc. The temperature extremes encountered in these various situations tend to heat or cool the breathing gas in these devices to levels that can cause psychological stress (e.g., claustrophobia), physical injury or even death. However, conventional (open and closed-circuit) breathing gas devices are not optimized to control the temperature of the breathing gas. Safe operation relies on the premise that users will exit the extreme environment when appropriate. Unfortunately, personnel may not be able to exit the extreme environment in a timely fashion due to any one of a variety of reasons, e.g., exit routes are blocked, decontamination or other safety procedures require prolonged use of the breathing gas device, etc.

Existing cooling schemes for high-temperature operation generally consist of using ice packs in a chest vest to provide skin temperature cooling. However, the use of ice packs on navy ships is undesirable because freezer space is limited and because ice may not be available during damage control situations. In reduced temperature operations such as underwater diving where it may be necessary to heat the breathing gas, hot water is typically pumped to a heat exchanger in contact with the breathing gas. However, this requires a heating element and mechanical pump which adds to the size and weight of the breathing gas device. Furthermore, in out-of-water low temperature extreme environments, a heating fluid reservoir would also have to be provided.

SUMMARY OF THE INVENTION

Accordingly, it is an object of the present invention to provide an apparatus that can be used to heat or cool breathing gas to compensate for ambient temperature extremes.

Another object of the present invention is to provide an apparatus that can be readily used with conventional breathing gas devices to control the temperature of the device's breathing gas.

Still another object of the present invention is to provide an apparatus that can be adapted to heat or cool a breathing gas without requiring the use of special storage facilities.

Other objects and advantages of the present invention will become more obvious hereinafter in the specification and drawings.

In accordance with the present invention, a device is provided for modifying the temperature of a breathing or other gas supplied through a conduit. A heat exchanger is mounted in-line with the conduit such that the gas passes through the heat exchanger. A thermoelectric device has first and second thermally conductive plates separated by at least one thermoelectric couple. The first thermally conductive plate is in thermal contact with the heat exchanger. A phase change material is in thermal contact with the second thermally conductive plate. A voltage is applied to the thermoelectric couple(s) to maintain the first and second thermally conductive plates at different temperatures. The phase change material changes from a first phase to a second phase at a phase change temperature that is selected to be between the different temperatures of the first and second thermally conductive plates. In this way, heat is transferred between the heat exchanger and the phase change material via the thermoelectric device.

DETAILED DESCRIPTION OF THE INVENTION

Figure 1:
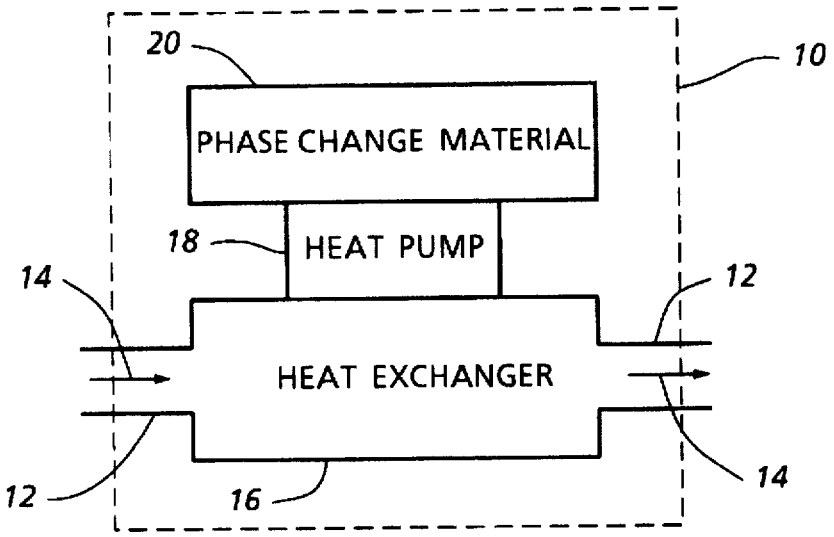
FIG. 1 is a schematic representation of the breathing gas temperature modification device useful for describing the operating principles of the present invention.

Referring now to the drawings, and more particularly to FIG. 1, a schematic view of the gas temperature modification device of the present invention is contained within dashed-line box 10. FIG. 1 will be used to describe the operating principles of the present invention. Device 10 is shown mounted in-line with conduit 12 carrying a gas referenced by arrow 14. Depending on the application environment, device 10 can be configured to heat or cool gas 14 as appropriate. For purpose of illustration, it will be assumed that device 10 is configured for cooling gas 14 as it passes through device 10. While the present invention will be described herein for its use with breathing gas devices, it is not so limited. As will be appreciated by one skilled in the art, the present invention can easily be adapted to modify the temperature of any gas or liquid flowing therethrough.

In general, device 10 includes heat exchanger 16, heat pump 18 and phase change material 20. Heat exchanger 16 is mounted in-line with conduit 12 and typically defines a flow path that maximizes contact area and minimizes drag around numerous heat exchanger fins (not shown in FIG. 1). The heat absorbed from gas 14 is transferred by heat pump 18 to phase change material 20 which then absorbs the transferred heat. Phase change material 20 absorbs heat from gas 14 (and heat produced by heat pump 18) when the ambient temperature is greater than that with which heat could be efficiently exchanged by heat exchanger 16. For heating/cooling a breathing gas, phase change material 20 is a paraffin, i.e., a member of the methane series having the general formula $C_nH_{2n+2}$. As will be explained further below, phase change material 20 is typically in particle or powder form and can be microencapsulated with a thermally conductive material.

Figure 2:
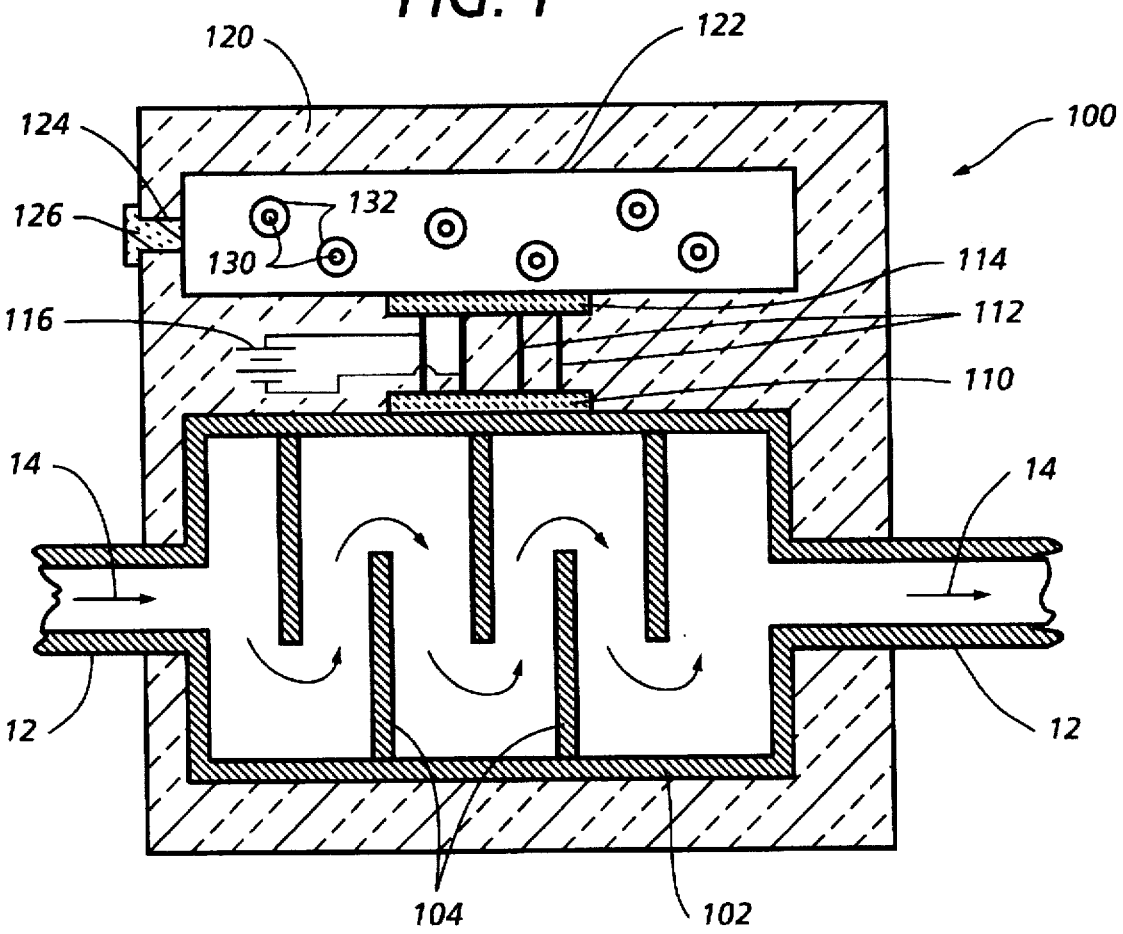
FIG. 2 is, in-part, a schematic and, in-part, a cross-sectional view of a first embodiment of the present invention.

An embodiment of the breathing gas temperature modification device is shown in FIG. 2 and is referenced generally by numeral 100. Device 100 is used to cool (or heat) gas 14 passing therethrough along conduit 12. Gas 14 flows into heat exchanger body 102 having numerous heat exchanger fins 104 for, in the case of cooling the gas, absorbing heat from gas 14. Heat exchanger body 102 and fins 104 are therefore made from a highly thermal conductive material as is known in the art. Typically, heat exchanger body 102 is of compact and lightweight design.

Heat exchanger body 102 is in intimate thermal contact with first plate 110 of a solid-state thermoelectric cooler (TEC) device. The TEC device also includes one or more thermoelectric couples 112 separating and thermally connecting first plate 110 with second plate 114. Second plate 114 is in contact with phase change material 130. Battery 116 is connected to thermoelectric couples 112 for activating the TEC device as will be explained further below. As is known in the art, first plate 110 and second plate 114 are made from a thermally conductive material that is non-conducting in the electrical sense. Typically, first plate 110 and second plate 114 are made from a ceramic material. Thermoelectric couples 112 are typically fabricated as thin strips of semi-conductor material as is known in the art. Commercial suppliers of such thermoelectric couples include Melcor located in Trenton, N.J., and Marlow Industries located in Dallas, Tex.

Encasing heat exchanger body 102 and the elements of the TEC device is thermally insulating shell 120. Suitable materials for shell 120 include insulating polymers such as high-temperature nylon or polyethylene or other structural polymers properly shrouded with flameproofing and insulating material. Shell 120 also forms chamber 122 for holding phase change material 130. Access hole 124 in chamber 122 is provided to permit the filling/emptying of phase change material 130 from chamber 122. Access hole 124 can be sealed by means of removable plug 126 which can also be fabricated of a thermally insulating material.

Prior to being immersed in the particular application environment, it is preferred to have phase change material 130 in its solid phase. For efficient heat transfer, phase change material 130 is in particle or powder form to create a greater heat transfer surface area per packed volume. In addition, if phase change material 130 is flammable and/or toxic, phase change material 130 can be encased by inflammable microencapsulant 132 that transfers heat. One such microencapsulant and microencapsulation process is commercially available through Frisby Technologies, Freeport, N.Y.

In operation, gas 14 flows through heat exchanger body 102 as shown. Assuming gas 14 is to be cooled, a voltage is applied by battery 116 to thermoelectric couples 112. In order to cool gas 14, the voltage is chosen such that first plate 110 is cold relative to second plate 114. In this way, heat is conducted from heat exchanger body 102 through first plate 110 and thermoelectric couples 112 to second plate 114 where the heat is absorbed into phase change material 130. For proper operation of the present invention, the phase change temperature of phase change material 130 is between the activated temperatures of first plate 110 and second plate 114. (If gas 14 is to be heated, the voltage applied by battery 116 causes second plate 114 to cold relative to first plate 110 in order to conduct heat from phase change material 130 to heat exchanger body 102.) Second plate 114 disposes of its absorbed heat by conducting it into (microencapsulated) phase change material 130 which is cooler than second plate 114 because it is changing phase. When phase change material 130 reaches its solid-liquid melting point, it remains at that temperature until all of the solid material changes phase. During this time, the temperature of phase change material remains relatively constant. Thus, the phase change material serves as a thermal buffer so that the thermal electric chip can operate in an electrically efficient fashion even when the device is in a high temperature environment and cannot exhaust the heat externally.

As mentioned above, phase change material 130 is a paraffin. Paraffins are preferred because, in general, they melt (i.e., cross the liquid-solid line) at appropriate temperatures for cooling and heating temperatures generally associated with breathing gas devices, have very high energy density on a weight basis, are relatively non-toxic, and are cost effective in their raw form. Paraffins can also be readily shaped to fit an available space and can be encapsulated as described above thereby offering additional benefits in terms of toxicity and flammability. In applications where gas 14 is a breathing gas, a number of suitable paraffins are listed below. The choice of phase a change material 130 is dependent on both the expected application environment and storage facilities for device 100.

| Compound Name | Carbon Atom Number | Melting Point (°F.) |
|---|---|---|
| n-Tetradecane | 14 | 42.6 |
| n-Pentadecane | 15 | 50.5 |
| n-Hexadecane | 16 | 64.8 |
| n-Heptadecane | 17 | 71.6 |
| n-Octadecane | 18 | 82.8 |
| n-Nonadecane | 19 | 89.8 |
| n-Eicosane | 20 | 98.2 |
| n-Heneicosane | 21 | 104.9 |
| n-Docosane | 22 | 111.9 |
| n-Tricosane | 23 | 117.7 |
| n-Tetracosane | 24 | 123.6 |

In all applications, it may become necessary to restore or recharge phase change material 130 to is pre-use state. This can be accomplished by either replacing phase change material 130 or restoring phase change material 130. The restoration of phase change material 130 to its pre-use state can be aided by providing the device of the present invention with a second heat exchanger coupled directly to phase change material 130. For example, as shown in the embodiment depicted in FIG. 3, heat exchanger 140 can be placed in intimate thermal contact with phase change material 130.

Heat exchanger 140 is enclosed in thermally insulted chamber 142 that can be opened to let the ambient environment pass over heat exchanger 140. In the illustrated embodiment, chamber 142 is formed by insulating shell 144 which could be made contiguous with shell 120. Either end of chamber 142 is sealed with thermostatic valves 146 and 148, respectively. Thermostatic valves 146 and 148 could be realized by the use of shaped memory alloy flaps that open/close chamber 142 in accordance with relative temperature conditions between chamber 142 and the ambient environment. For example, thermostatic valves 146 and 148 could be configured to remain closed when the temperature in chamber 142 is less than the temperature of the ambient environment and open when the temperature in chamber 142 is greater than the temperature of the ambient environment. In this way, phase change material 130 can be restored, i.e., cooled or heated as the case may be, to its pre-use state. A thermostatically controlled fan 150 could be provided in chamber 142 to improve the flow of the ambient environment through chamber 142. Fan 150 would typically be powered by battery 116.

The advantages of the present invention are numerous. The temperature of breathing or other gases is easily modified using a combination of a heat exchanger, a TEC device and a phase change material. The choice of phase change material allows the invention to be adapted for use as either a gas cooler or heater. The device of the present invention is self-contained and can be easily constructed to mount in-line with a gas conduit.

In fire-fighting operations, the device is turned on while the operator is outside the burning structure. During this time, the device exhausts (breathing gas) heat into the paraffin and, in the case of the embodiment of FIG. 3, heat is exhausted from the paraffin back into the relatively cool ambient air. Once in the high-temperature environment, the thermostatic valves close to prevent the paraffin from being in thermal contact with the hot outside air. The paraffin melts as heat from the fireman's breathing gas is absorbed by the paraffin. Once the fireman exits the fire, the thermostatic valves open and the paraffin begins to solidify.

Figure 3:
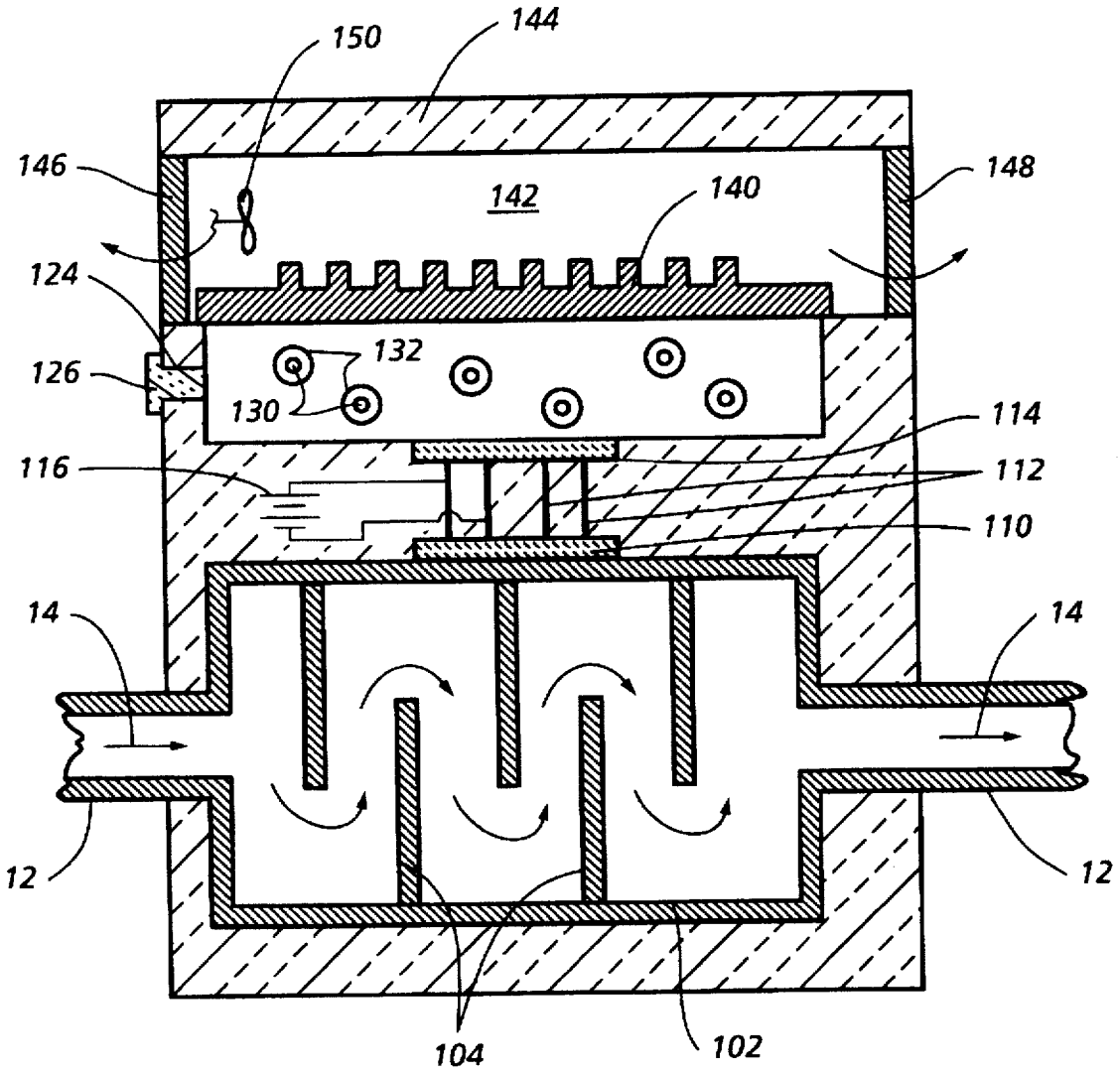
FIG. 3 is, in-part, a schematic and, in-part, a cross-sectional view of a second embodiment of the present invention.

In hazmat applications, the operator is typically equipped with a breathing gas device and is wearing a environmental suit. These suits are generally extremely warm thereby increasing the operator's chances of suffering from heat and/or claustrophobic stresses. Accordingly, the breathing gas device of the present invention can be configured to operate as a chiller to cool the breathing gas by transporting the breathing gas heat to the paraffin. The device's operating time can be extended by moving heat out of the paraffin and into the environment if the device is configured as shown in FIG. 3.

In extremely cold environments, the breathing gas device is configured so that breathing gas is inhaled through the device. Thus, a paraffin is selected such that it can be liquified by being in a relatively warm environment, e.g., a tent, a sleeping bag, etc. For a breathing gas device equipped as in FIG. 3, the thermostatic control valves would open to allow heat to recharge the paraffin automatically as the ambient temperature allows. The device heats the breathing gas as the thermoelectric chip transfers heat from the paraffin, i.e., the paraffin solidifies.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the united states is:

1. A device for modifying the temperature of gas supplied through a conduit, comprising:

a heat exchanger mounted in-line with the conduit such that the gas passes through said heat exchanger;

a thermoelectric device having first and second thermally conductive plates separated by at least one thermoelectric couple, said first thermally conductive plate in thermal contact with said heat exchanger, wherein voltage applied to said at least one thermoelectric couple maintains said first and second thermally conductive plates at different temperatures;

a phase change material, in thermal contact with said second thermally conductive plate, for changing from a first phase to a second phase at a phase change temperature between said different temperatures as heat is transferred between said heat exchanger and said phase change material via said thermoelectric device;

a second heat exchanger thermally coupled to said phase change material for transferring heat between the ambient environment and said phase chance material to aid in the restoration of said phase chance material in said second phase to said first phase; and means for thermally isolating said second heat exchanger from the ambient environment until the temperature of the ambient environment is suitable to begin restoring said phase change material in said second phase to said first phase.

2. A device as in claim 1 wherein said phase change material is in the form of discrete elements microencapsulated in a thermally conductive, non-flammable material.

3. A device as in claim 1 wherein said phase change material is a paraffin.

4. A device as in claim 1 wherein said phase change material is selected from the group consisting of n-tetradecane, n-pentadecane, n-hexadecane, n-heptadecane, n-octadecane, n-nonadecane, n-elcosane, n-heneicosane, n-docosane, n-tricosane, and n-tetracosane.

5. A device as in claim 1 wherein said means for thermally isolating said second heat exchanger includes at least one thermostatic valve coupled to said second heat exchanger and exposed to the ambient environment, said at least one thermostatic valve opening when the temperature of the ambient environment is suitable to begin restoring said phase change material in said second phase to said first phase.

6. A device as in claim 1 wherein said means for thermally isolating said second heat exchanger includes means for circulating the ambient environment through said second heat exchanger when the temperature of the ambient environment is suitable to begin restoring said phase change material in said second phase to said first phase.

7. A device for modifying the temperature of breathing gas supplied through an inhalation conduit to a user's facemask, comprising:

a heat exchanger mounted in-line with the inhalation conduit, wherein the breathing gas is caused to pass through said heat exchanger prior to being passed to the user's facemask;

a thermoelectric device having first and second thermally conductive plates separated by at least one thermoelectric couple, said first thermally conductive plate in thermal contact with said heat exchanger;

a voltage source connected to said at least one thermoelectric couple for applying a voltage to said at least one thermoelectric couple so that said first and second thermally conductive plates are maintained at different temperatures;

a phase change material, in thermal contact with said second thermally conductive plate, for changing from a first phase to a second phase at a phase change temperature between said different temperatures as heat is transferred between said heat exchanger and said phase change material via said thermoelectric device;

a thermally insulating shell encasing said heat exchanger, said thermoelectric device and said phase change material;

a second heat exchanger thermally coupled to said phase chance material for transferring heat between the ambient environment and said phase chance material to aid in the restoration of said phase change material in said second phase to said first phase; and means for thermally isolating said second heat exchanger from the ambient environment until the temperature of the ambient environment is suitable to begin restoring said phase change material in said second phase to said first phase.

8. A device as in claim 7 wherein said thermoelectric device is a solid-state thermoelectric cooler.

9. A device as in claim 8 wherein said thermoelectric cooler is a single-stage thermoelectric cooler.

10. A device as in claim 8 wherein said thermoelectric cooler is a multi-stage thermoelectric cooler.

11. A device as in claim 7 wherein said phase change material is in the form of discrete elements microencapsulated in a thermally conductive, non-flammable material.

12. A device as in claim 7 wherein said means for thermally isolating said second heat exchanger includes at least one thermostatic valve coupled to said second heat exchanger and exposed to the ambient environment, said at least one thermostatic valve opening when the temperature of the ambient environment is suitable to begin restoring said phase change material in said second phase to said first phase.

13. A device as in claim 7 wherein said means for thermally isolating said second heat exchanger includes means for circulating the ambient environment through said second heat exchanger when the temperature of the ambient environment is suitable to begin restoring said phase change material in said second phase to said first phase.

14. A device as in claim 7 wherein said phase change material is a paraffin.

15. A device as in claim 7 wherein said phase change material is selected from the group consisting of n-tetradecane, n-pentadecane, n-hexadecane, n-heptadecane, n-octadecane, n-nonadecane, n-elcosane, n-heneicosane, n-docosane, n-tricosane, and n-tetracosane.

* * * * *